United States Patent [19]

Moreland

[11] 4,433,738

[45] Feb. 28, 1984

[54] METHOD AND APPARATUS FOR USE WHEN CHANGING THE DIRECTION OF A WELL BORE

[76] Inventor: Ernest W. Moreland, Rte. 4, Box 24, New Iberia, La. 70560

[21] Appl. No.: 334,259

[22] Filed: Dec. 24, 1981

[51] Int. Cl.[3] ..... E21B 7/06

[52] U.S. Cl. ..... 175/61; 175/344; 175/406

[58] Field of Search ..... 175/57, 61, 344, 345, 175/346, 347, 385, 406

[56] References Cited

U.S. PATENT DOCUMENTS

| | | | |
|---|---|---|---|
| 2,553,874 | 5/1951 | Spaulding et al. | 175/406 |
| 2,685,431 | 8/1954 | James | 175/406 |
| 3,398,804 | 8/1968 | Holbert | 175/61 |
| 4,330,043 | 5/1982 | Sheffield et al. | 175/406 |
| 4,333,539 | 6/1982 | Lyons et al. | 175/61 |

FOREIGN PATENT DOCUMENTS

| | | | |
|---|---|---|---|
| 460368 | 6/1973 | U.S.S.R. | 175/406 |

OTHER PUBLICATIONS

Eastman Oil Well Survey Document, Eastco, World Oil, Feb. 15, 1955.

*Primary Examiner*—James A. Leppink
*Assistant Examiner*—William P. Neuder
*Attorney, Agent, or Firm*—Vaden, Eickenroht, Thompson, Bednar & Jamison

[57] ABSTRACT

A method is disclosed of smoothing out a curved section of a well bore that has been drilled with a bent sub-downhole motor assembly. The method includes moving a reamer with a body having a cylindrical section and a lower tapered section equipped with a plurality of cylindrical cutters on each section through the curved section, while being rotated by the drilling assembly to be used to continue drilling the well bore below the curved section.

1 Claim, 9 Drawing Figures

FIG.1
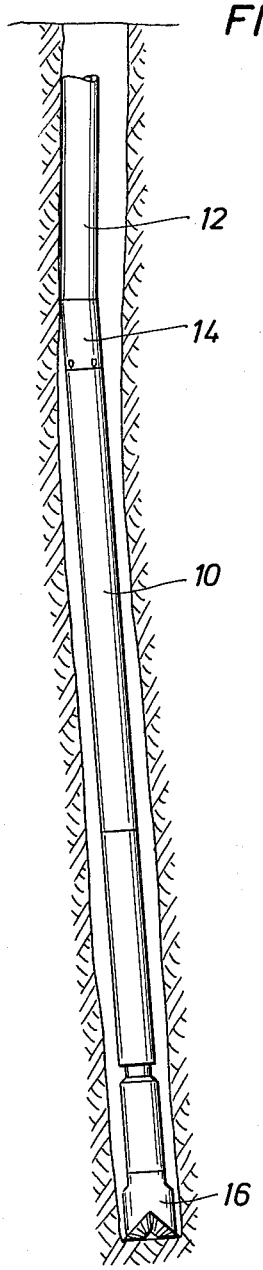
FIG. 2
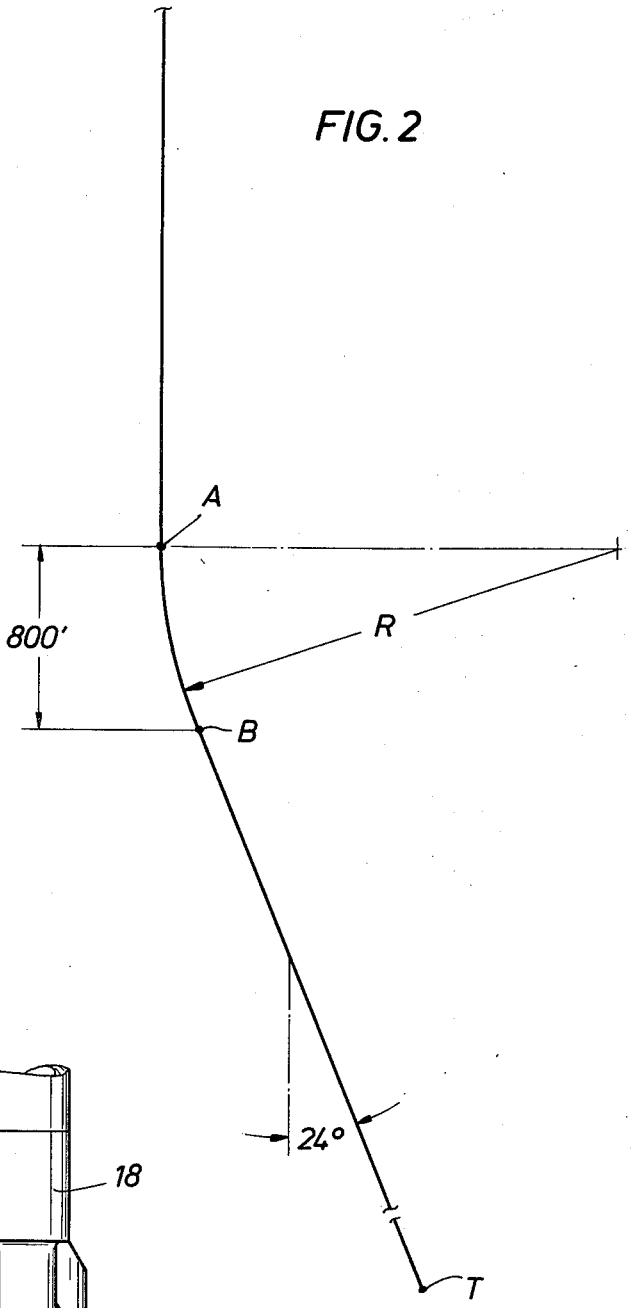
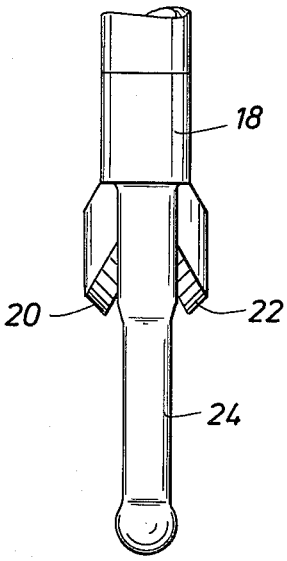
FIG. 3
PRIOR ART

METHOD AND APPARATUS FOR USE WHEN CHANGING THE DIRECTION OF A WELL BORE

This invention relates to directional drilling generally, and in particular to a method of and apparatus for use when changing the direction of a well bore.

Usually, when drilling a directional well, the well bore is drilled more or less vertically to a predetermined depth below the surface. Then the dip angle or angle of inclination of the hole is changed at a rate of two to three degrees per 100 feet to slowly turn the longitudinal axis of the well bore until it is pointing toward the preselected target where the well bore is to bottom out. The well bore is then drilled straight toward the target. On some occasions, the dip angle of the well bore is changed and the hole is drilled along a straight line until it approaches a point above the target. Then the dip angle is changed back to the vertical and the hole is drilled approximately straight downwardly to the target area. In addition to the planned changes in the inclination of a well bore, corrections in both inclination or azimuth or both may be necessary to keep the well bore heading in the desired direction.

Changes in the dip angle or azimuth of a well bore are most commonly accomplished using a downhole motor to drive the bit and a bent sub that will tend to cause the bit to change the direction of the well bore at a preselected rate, usually two to three degrees per 100 feet.

When changing the direction of the well bore using a downhole motor and a bent sub, the downhole assembly is not as rigid as it would be during normal drilling operations. As a result, the bit does not always produce a smooth, uniformly curved, portion of well bore, but one that may have dog legs, relatively sharp turns, and spirals. As a result, it is often difficult, when the curved section has been drilled and conventional drilling resumed, for the drill bit, which is now attached to a relatively rigid drilling assembly made up of drill collars and costly stabilizers, to get back to bottom. For this reason, the usual practice is to follow a run with a bent sub-downhole motor assembly with a hole opener, such as the one shown in FIG. 3 of the attached drawings. A hole opener, however, does not always smooth out the dog legs and sharp turns to the extent desired. In addition, the vibrations that a drilling operation produces are often severe and have caused the ball guide that extends below the cutters to break off and have to be fished from the hole before drilling can continue.

Therefore, it is an object of this invention to provide a method of and apparatus for smoothing the curved portion of a directional hole after it has been drilled with a bent sub-downhole motor assembly so that the regular drilling assembly and bit can be run to the bottom of the hole without incident. By smoothing out the dog legs, sharp turns, etc., that are often in this section of the hole after it has been drilled with the downhole motor, the chances of the drill collars in the downhole assembly becoming stuck are greatly reduced.

It is another object of this invention to provide an improved reamer for use in the practice of this method of smoothing out the curved section of a well bore drilled with a bent sub-downhole motor assembly.

These and other objects, advantages, and features of this invention will be apparent to one skilled in the art from a consideration of this specification, including the attached drawings and appended claims.

In the drawings:

FIG. 1 is a view, in elevation, of a bent sub-downhole motor assembly drilling the curved section of a well bore;

FIG. 2 shows one path that can be taken by a well bore that includes one curved section to reach a target area spaced horizontally from a vertical line extending below a drilling rig;

FIG. 3 is a view, in elevation, of a hole opener of the type presently used to smooth out a well bore drilled with a bent sub-downhole motor assembly;

Figure 4:
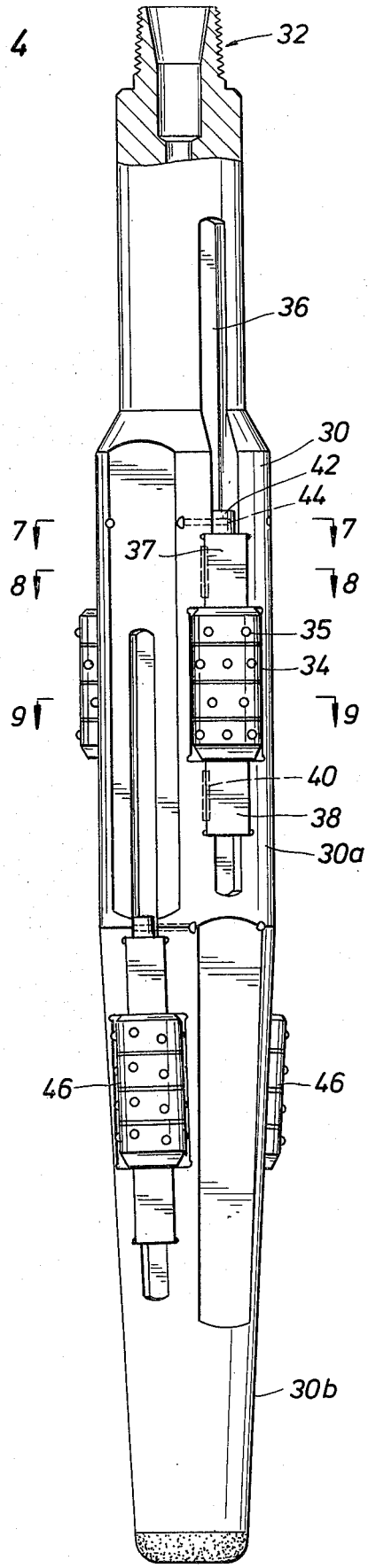
FIG. 4 is a side view of the reamer of this invention for use in the practice of the method of this invention.

Downhole motor 10 in FIG. 1 is connected to drill string 12 through bent sub 14. A bent sub can also be used to change the inclination or the azimuth of the well bore or both the inclination and azimuth. This description, however, will assume that only dip angle is being changed.

The sub is bent at a preselected angle to cause bit 16 to tend to change the angle the well bore makes with the vertical at a substantially constant rate, usually at about two to three degrees per 100 feet of vertical depth of the well bore. If the dip angle of the hole is changed at such a rate, the well bore will follow a radius of curvature R as shown in FIG. 2 throughout the section between points A and B, where the dip angle of the well bore is changed to the desired amount to aim the well bore at target T. In the example shown, the well bore is changed from one that is vertical to one that has a 24° dip angle with the change occurring at 3° per 100 feet, which means the section from A to B has a vertical depth of 800 feet.

As discussed above, it has been the practice in the past to follow the run of a downhole motor and bent sub with a hole opener. Such a tool is shown in FIG. 3. It includes body 18 and cutters 20 and 22 mounted on the body. Ball guide or "bull nose" 24 is attached to body 18, or it may be an integral part thereof, and extends below the cutters.

Hole openers are designed to do just that—open or increase the diameter of the well bore. A small diameter hole, called a rat hole, is drilled first. This is followed by a hole opener to increase the diameter the desired amount. The ball guide extends into the rat hole to keep the hole opener from drifting laterally of the longitudinal axis of the rat hole.

When hole openers are run behind a bent sub-downhole motor assembly, the hole opener is the same diameter as the bit used with the bent sub assembly. It is relatively short. One designed to cut a $12\frac{1}{4}''$ hole being only 40" in length. Thus, they will tend to follow the meanderings of the well bore rather than straighten them out.

Another problem with hole openers is that the ball guides break off frequently. Usually, the drilling assembly includes stabilizers. In an inclined hole, the stabilizer blades drag on the low side of the well bore. Sometimes, a stabilizer blade will dig in the side of the well bore, momentarily stopping the rotation of the drill bit before the tongue in the pipe breaks the blade free, only to be repeated by another stabilizer blade. This produces tremendous vibrations in the drill string and a wobbling action on the unsupported ball guide. In many cases, this has been sufficient to break the ball guide from the body of the hole opener.

Therefore, it is one of the features of this invention to provide a unique reamer for use in smoothing the curved section of a well bore following a downhole motor run. The preferred embodiment of this reamer is shown in FIG. 4. It includes body 30 having a cylindrical section 30*a* and lower tapered section 30*b*. Above the cylindrical section, the diameter of the body is reduced and threaded pin 32 is provided for attaching the reamer to the bottom of the drilling assembly. A first set of three cylindrical cutters 34 are mounted for rotation on cylindrical section 30*a* of the body. In the embodiment shown, the cutters are provided with button inserts 35 which is the type cutter used for very hard and abrasive formations. For medium to hard formations and the inserts would be replaced by longitudinally extending teeth.

The cutters are mounted for rotation around an axis parallel to the surface of section 30*a* of the body. The diameter of the cutters and the axis around which they rotate are such that the outside surface of the cutters are spaced outwardly beyond the surface of the cylindrical section of the body so that it is the cutters that engage the well bore, not the body of the reamer.

Also, the cutters are positioned so the radial distances, R, from the center line of body 30 to the outermost surface of the cutters is approximtely equal to the radius of the bit that drilled the well bore.

Figure 5:
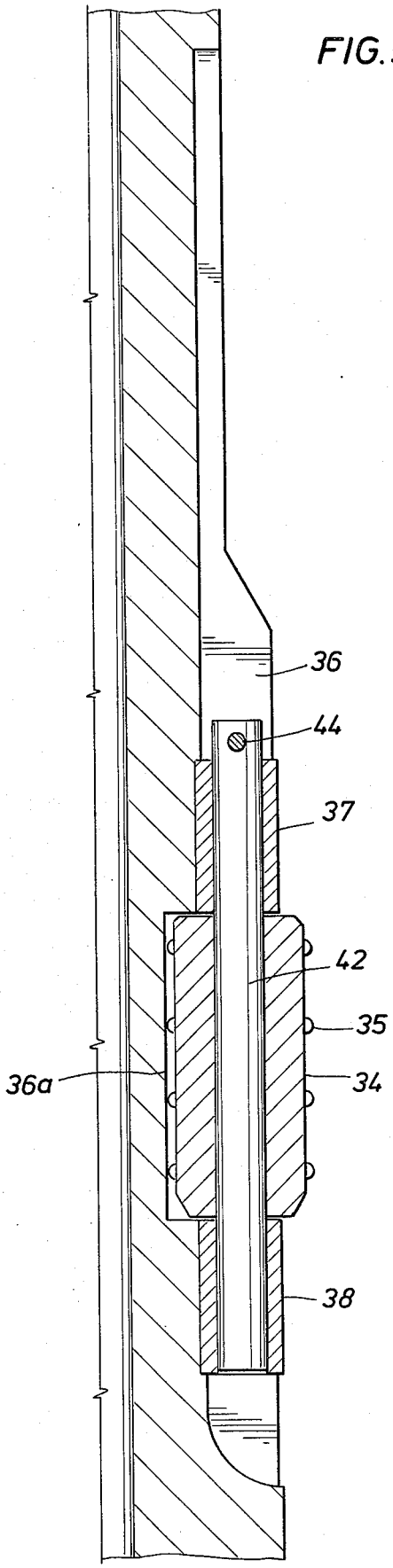
FIG. 5 is a sectional view through one of the cylindrical cutters mounted on the side of the cylindrical section of the reamer of FIG. 4.
Figure 8:
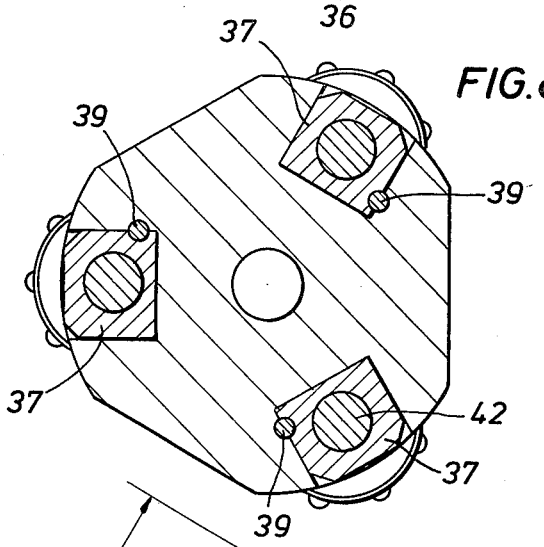
FIG. 8 is a cross-sectional view taken along line 8—8 of FIG. 4.
Figure 9:
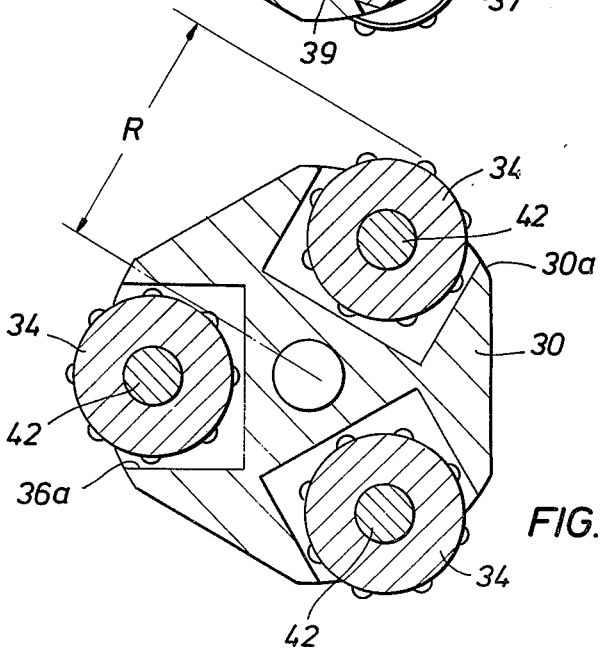
FIG. 9 is a cross-sectional view taken along line 9—9 of FIG. 4.

The details of this mounting are shown in FIG. 5. Each cutter is located in one of the longitudinally extending grooves 36 that are milled in the side of the body. Each groove has enlarged section 36*a* in which the cutter is located, as shown in FIG. 9. Above and below section 36*a* the groove narrows down to receive top and bottom bearing blocks 37 and 38. Above the bearing blocks, the groove again narrows to provide shoulders to hold the bearing blocks in position on each side of the cutter. Pins 39, as shown in FIG. 8, engage vertical grooves in the bearing blocks and the body to hold the upper bearing blocks in position in the grooves. The lower bearing blocks are held in position in a similar manner by pins 40 shown in phantom lines in FIG. 4.

Figure 7:
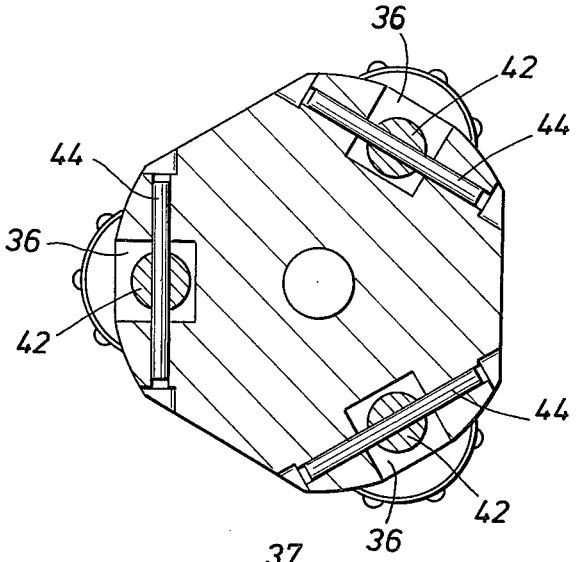
FIG. 7 is a view taken along line 7—7 of FIG. 4.

Cutter mounting pin 42 extends through the cutter and through the bottom and top bearing blocks to hold the members in the groove and to provide a shaft around which cutter 34 can rotate. The cutter pin is held against rotation and longitudinal movement by lock pin 44 that extends through a transverse opening in the body and through the upper end of the cutter pin, as shown in FIG. 7.

To replace the cutter, it is only necessary to pull lock pin 44, drive cutter mounting pin 42 upwardly through the upper end of slot 36, and remove the cutter laterally out of the slot, once pin 42 has cleared the cutter. The new cutter is positioned between the two bearing blocks and the mounting pin and lock pin reinserted to complete the mounting of the new cutter.

Figure 6:
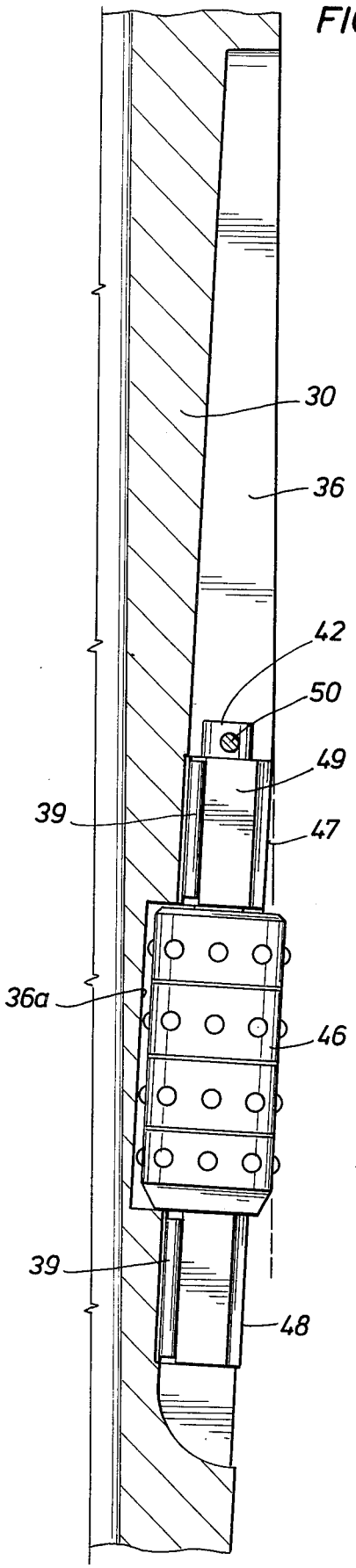
FIG. 6 is a cross-sectional view of one of the cylindrical rollers mounted on the side of the tapered section of the reamer of FIG. 4.

A second set of three cutters 46 are mounted on tapered portion 30*b* of the body. These cutters are mounted in the same manner as described above in connection with FIG. 5 having top bearing block 47, bottom bearing block 48 as shown in FIG. 6, along with cutter pin 49 and lock pin 50.

Cutters 46 are positioned on tapered section 30*b* of the body just below the intersection on the tapered and cylindrical sections so that the cutters extend beyond the cylindrical section as shown by the dotted line in FIG. 6. They do not extend outwardly from the centerline of the body any further than do cutters 34, but they may extend the same amount. This causes the cutters on the tapered section to guide the reamer as it moves through the well bore. These cutters will also cut away a portion of the well bore if required for the passage of the reamer and reduce the amount of well bore that has to be removed by cutters 34.

In the practice of this invention, the curved section of the well bore is drilled until the well bore has the desired dip angle using a downhole assembly made up of a bent sub, a downhole motor, and a drilling bit, as shown in FIG. 1. This assembly is then removed from the well bore and the drilling assembly that will be used to drill ahead, i.e., one that has the same number of drill collars and stabilizers that are intended to be used to drill toward the target, is made up with the reamer of this invention connected at the lower end instead of a drill bit.

The drilling assembly and reamer are run into the hole to the top of the curved section to be reamed, rotation of the drilling assembly is started, and the reamer and drilling assembly is moved through the curved section of the well bore. As explained above, this removes or reduces any dog legs, spirals, and other sharp turns that may exist in the curved section of the well bore due to the flexibility of the bent sub-downhole motor assembly that drilled it. The drilling assembly and the stabilizer are then removed from the well bore, the stabilizer is replaced by a drilling bit, and drilling can be resumed with the drill bit and drilling assembly being assured of passing smoothly through the curved section to the bottom of the well bore.

From the foregoing it will be seen that this invention is one well adapted to attain all of the ends and objects hereinabove set forth, together with other advantages which are obvious and which are inherent to the apparatus and method.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A method of changing the direction of a well bore comprising the steps of drilling a section of a well bore using a downhole motor to rotate the bit and a bent sub to change the direction of the well bore the desired amount, removing the bent sub, downhole motor and bit from the well bore, reaming the section of the well bore drilled with the downhole motor with a reamer of the same diameter as the bit used to change the direction of the well bore and the drilling assembly to be used to drill ahead, removing the reamer and the drilling assembly from the well bore, replacing the reamer with a drilling bit of the same diameter as the previously used bit, running the bit and drilling assembly to the bottom of the well bore, and drilling ahead in the desired direction.

* * * * *